US007079079B2

(12) United States Patent
Jo et al.

(10) Patent No.: US 7,079,079 B2
(45) Date of Patent: Jul. 18, 2006

(54) LOW PROFILE COMPACT MULTI-BAND MEANDERLINE LOADED ANTENNA

(75) Inventors: Young-Min Jo, Rockledge, FL (US); Frank M. Caimi, Vero Beach, FL (US)

(73) Assignee: SkyCross, Inc., Melbourne, FL (US)

( * ) Notice: Subject to any disclaimer, the term of this patent is extended or adjusted under 35 U.S.C. 154(b) by 0 days.

(21) Appl. No.: 10/881,742

(22) Filed: Jun. 30, 2004

(65) Prior Publication Data

US 2006/0001575 A1 Jan. 5, 2006

(51) Int. Cl.
*H01Q 1/24* (2006.01)

(52) U.S. Cl. ..... 343/700 MS; 343/702; 343/829; 343/846

(58) Field of Classification Search ..... 343/700 MS, 343/702, 829, 846
See application file for complete search history.

(56) References Cited

U.S. PATENT DOCUMENTS

| | | | | |
|---|---|---|---|---|
| 3,838,429 | A | 9/1974 | Reggia | |
| 3,925,784 | A | 12/1975 | Phelan | |
| 4,495,503 | A | 1/1985 | Morman | |
| 4,598,276 | A | 7/1986 | Tait | |
| 5,313,216 | A | 5/1994 | Wang et al. | |
| 5,608,417 | A | 3/1997 | de Vall | |
| 5,790,080 | A | 8/1998 | Apostolos | |
| 5,926,139 | A * | 7/1999 | Korisch | 343/702 |
| 6,064,351 | A | 5/2000 | Mandai et al. | |
| 6,137,453 | A | 10/2000 | Wang et al. | |
| 6,166,694 | A | 12/2000 | Ying | |
| 6,353,420 | B1 | 3/2002 | Chung | |
| 6,459,413 | B1 * | 10/2002 | Tseng et al. | 343/702 |
| 6,476,769 | B1 | 11/2002 | Lehtola | |
| 6,480,158 | B1 * | 11/2002 | Apostolos | 343/700 MS |
| 6,489,925 | B1 | 12/2002 | Thursby et al. | |
| 6,492,953 | B1 | 12/2002 | Apostolos | |
| 6,573,869 | B1 | 6/2003 | Moore | |
| 6,590,543 | B1 | 7/2003 | Apostolos | |
| 6,650,295 | B1 | 11/2003 | Ollikainen et al. | |
| 6,707,428 | B1 * | 3/2004 | Gram | 343/700 MS |
| 6,717,548 | B1 * | 4/2004 | Chen | 343/700 MS |
| 6,741,214 | B1 * | 5/2004 | Kadambi et al. | 343/700 MS |

* cited by examiner

*Primary Examiner*—Michael C. Wimer
(74) *Attorney, Agent, or Firm*—John L. DeAngelis, Jr.; Beusse Wolter Sanks Mora & Maire, P.A.

(57) ABSTRACT

An antenna for transmitting and receiving radio frequency energy. The antenna comprises a conductive radiator comprising a first and a second conductive region for providing a first and a second current path length. A feed conductor and a ground conductor operate as meanderline (or slow wave) elements to provide an electrical length longer than a physical length.

22 Claims, 4 Drawing Sheets

LOW PROFILE COMPACT MULTI-BAND MEANDERLINE LOADED ANTENNA

FIELD OF THE INVENTION

The present invention is directed generally to antennas for receiving and transmitting radio frequency signals, and more particularly to such antennas operative in multiple frequency bands.

BACKGROUND OF THE INVENTION

It is known that antenna performance is dependent upon the size, shape and material composition of the antenna elements, the interaction between elements and the relationship between certain antenna physical parameters (e.g., length for a linear antenna and diameter for a loop antenna) and the wavelength of the signal received or transmitted by the antenna. These physical and electrical characteristics determine several antenna operational parameters, including input impedance, gain, directivity, signal polarization, resonant frequency, bandwidth and radiation pattern.

Generally, an operable antenna should have a minimum physical antenna dimension on the order of a half wavelength (or a multiple thereof) of the operating frequency to limit energy dissipated in resistive losses and maximize transmitted or received energy. A quarter wavelength antenna (or multiples thereof) operative above a ground plane exhibits properties similar to a half wavelength antenna. Communications device product designers prefer an efficient antenna that is capable of wide bandwidth and/or multiple frequency band operation, electrically matched to the transmitting and receiving components of the communications system, and operable in multiple modes (e.g., selectable signal polarizations and selectable radiation patterns).

The half-wavelength dipole antenna is commonly used in many applications. The radiation pattern is the familiar donut shape with most of the energy radiated uniformly in the azimuth direction and little radiation in the elevation direction. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical gain is about 2.15 dBi.

The quarter-wavelength monopole antenna disposed above a ground plane is derived from the half-wavelength dipole. The physical antenna length is a quarter-wavelength, but interaction of the electromagnetic energy with the ground plane causes the antenna to exhibit half-wavelength dipole performance. Thus, the radiation pattern for a monopole antenna above a ground plane is similar to the half-wavelength dipole pattern, with a typical gain of approximately 2 dBi.

The common free space (i.e., not above ground plane) loop antenna (with a diameter of approximately one-third the wavelength of the transmitted or received frequency) also displays the familiar donut radiation pattern along the radial axis, with a gain of approximately 3.1 dBi. At 1900 MHz, this antenna has a diameter of about 2 inches. The typical loop antenna input impedance is 50 ohms, providing good matching characteristics to the standard 50 ohm transmission line.

The well-known patch antenna provides directional hemispherical coverage with a gain of approximately 4.7 dBi.

Although small compared to a quarter or half wavelength antenna, the patch antenna has a relatively narrow bandwidth.

Given the advantageous performance of quarter and half wavelength antennas, conventional antennas are typically constructed so that the antenna length is on the order of a quarter wavelength of the radiating frequency and the antenna is operated over a ground plane, or the antenna length is a half wavelength without employing a ground plane. These dimensions allow the antenna to be easily excited and operated at or near a resonant frequency (where the resonant frequency (f) is determined according to the equation $c=\lambda f$, where c is the speed of light and $\lambda$ is the wavelength of the electromagnetic radiation). Half and quarter wavelength antennas limit energy dissipated in resistive losses and maximize the transmitted energy. But as the operational frequency increases/decreases, the operational wavelength decreases/increases and the antenna element dimensions proportionally decrease/increase. In particular, as the resonant frequency of the received or transmitted signal decreases, the dimensions of the quarter wavelength and half wavelength antenna proportionally increase. The resulting larger antenna, even at a quarter wavelength, may not be suitable for use with certain communications devices, especially portable and personal communications devices intended to be carried by a user. Since these antennas tend to be larger than the communications device, they are typically mounted with a portion of the antenna protruding from the communications device and thus are susceptible to breakage.

The burgeoning growth of wireless communications devices and systems has created a substantial need for physically smaller, less obtrusive, and more efficient antennas that are capable of wide bandwidth or multiple frequency-band operation, and/or operation in multiple modes (i.e., selectable radiation patterns or selectable signal polarizations). For example, operation in multiple frequency bands may be required for operation of the communications device with multiple communications systems, such as a cellular telephone system and a global positioning system. Operation of the device in multiple countries also requires multiple frequency band operation since communications frequencies are not commonly assigned among countries.

Smaller packaging of state-of-the-art communications devices, such as personal handsets, does not provide sufficient space for the conventional quarter and half wavelength antenna elements. It is generally not considered feasible to utilize a single antenna for each operational frequency or to include multiple matching circuits to provide proper resonant frequency operation from a single antenna. Thus physically smaller antennas operating in the frequency bands of interest and providing the other desired antenna-operating properties (input impedance, radiation pattern, signal polarizations, etc.) are especially sought after.

As is known to those skilled in the art, there is a direct relationship between physical antenna size and antenna gain, at least with respect to a single-element antenna, according to the relationship: $\text{gain}=(\beta R)\hat{}2+2\beta R$, where R is the radius of the sphere containing the antenna and $\beta$ is the propagation factor. Increased gain thus requires a physically larger antenna, while users continue to demand physically smaller antennas. As a further constraint, to simplify the system design and strive for minimum cost, equipment designers and system operators prefer to utilize antennas capable of efficient multi-band and/or wide bandwidth operation, to allow the communications device to access various wireless services operating within different frequency bands or such services operating over wide bandwidths. Finally, gain is limited by the known relationship between the antenna operating frequency and the effective antenna length (expressed in wavelengths). That is, the antenna gain is constant for all quarter wavelength antennas of a specific geometry i.e., at that operating frequency where the effective antenna length is a quarter of a wavelength of the operating frequency.

To overcome the antenna size limitations imposed by handset and personal communications devices, antenna designers have turned to the use of so-called slow wave structures where the structure's physical dimensions are not equal to the effective electrical dimensions. Recall that the effective antenna dimensions should be on the order of a half wavelength (or a quarter wavelength above a ground plane) to achieve the beneficial radiating and low loss properties discussed above. Generally, a slow-wave structure is defined as one in which the phase velocity of the traveling wave is less than the free space velocity of light. The wave velocity (c) is the product of the wavelength and the frequency and takes into account the material permittivity and permeability, i.e., $c/((\mathrm{sqrt}(\epsilon_r)\mathrm{sqrt}(\mu_r)))=\lambda f$. Since the frequency does not change during propagation through a slow wave structure, if the wave travels slower (i.e., the phase velocity is lower) than the speed of light, the wavelength within the structure is lower than the free space wavelength. The slow-wave structure de-couples the conventional relationship between physical length, resonant frequency and wavelength.

Since the phase velocity of a wave propagating in a slow-wave structure is less than the free space velocity of light, the effective electrical length of these structures is greater than the effective electrical length of a structure propagating a wave at the speed of light. The resulting resonant frequency for the slow-wave structure is correspondingly increased. Thus if two structures are to operate at the same resonant frequency, as a half-wave dipole, for instance, then the structure propagating a slow wave will be physically smaller than the structure propagating a wave at the speed of light. Such slow wave structures can be used as antenna elements or as antenna radiating structures.

BRIEF SUMMARY OF THE INVENTION

The present invention comprises an antenna comprising a radiating conductive structure having a first current path for providing a resonant condition at a first resonant frequency and a second current path for providing a resonant condition at a second resonant frequency. The antenna further comprises a common feed conductor for the first and the second current paths, wherein the feed conductor is connected to the radiating structure, and a common ground conductor for the first and the second current paths, wherein the ground conductor is connected to the radiating structure.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Before describing in detail the particular antenna in accordance with the present invention, it should be observed that the present invention resides primarily in a novel and non-obvious combination of hardware structures. So as not to obscure the disclosure with details that will be readily apparent to those skilled in the art, certain conventional elements and steps have been described and illustrated with lesser detail, while other elements and steps pertinent to understanding the invention have been described and illustrated in greater detail.

The antenna of the present invention comprises a shaped conductive radiator having one or more meanderline structures connected thereto for providing desired operating characteristics in a volume smaller than a prior art quarter-wave structure above a ground plane. In one embodiment, the conductive radiator comprises a conductive sheet formed by stamping or cutting the desired shape from a blank sheet of conductive material. Certain regions of the stamped sheet are then shaped and/or bent to form the various features of the antenna. The relatively small antenna volume permits installation in communications device handsets and other applications where space is at a premium. The antenna of the present invention is generally considered a low-profile antenna due to its height (typically in the range of 3 to 4 mm), but it is recognized by those skilled in the art that there is no generally accepted definition as to the height of a low-profile antenna. Compared to prior art antennas, the antenna of the present invention is also relatively small in size. These advantageous physical attributes of the antenna are realized by employing meanderline slow wave structures for certain antenna elements to provide a required electrical length, and further by employing current path structures that exhibit the necessary electrical length and are properly coupled to provide the desired resonant conditions and operating bandwidth.

Figure 1:
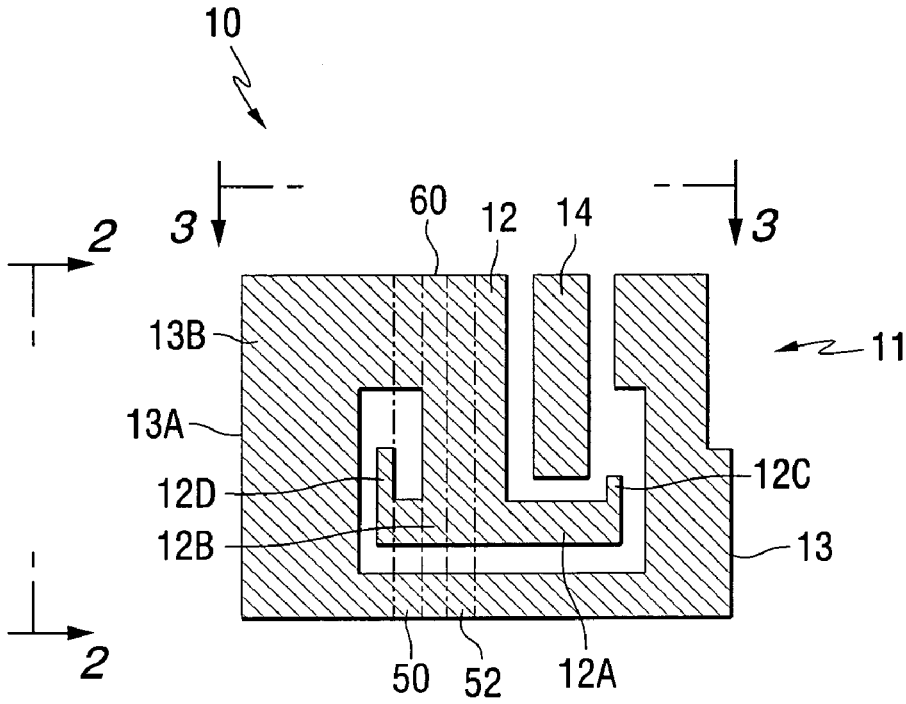
FIG. 1 is top view of an antenna constructed according to the teachings of the present invention.

One embodiment of an antenna 10 of the present invention is illustrated in a top view of FIG. 1. The antenna 10 comprises a radiator 11 further comprising a high band region 12 conductively contiguous with a low band region 13. A segment 14 is conductively connected to the low band region 13 as explained below in conjunction with FIG. 3.

In another embodiment (not illustrated) an edge 13A of a region 13B is displaced below a plane of the radiator 11 and forms an acute angle with the plane of radiator 11.

As is known to those skilled in the art, there is no physical line of demarcation between the high band region 12 and the low band region 13. Rather, these two regions generally identify conductive structures in which currents flow to establish two different resonant conditions for the antenna. A high frequency resonant condition is established by current flow through the high band region 12, and a low frequency resonant condition is established by current flow through the low band region 13. The high and low band regions 12 and 13 provide adequate current flow along their respective paths, with proper coupling between the regions 12 and 13 to produce the desired resonant conditions.

The antenna 10 further comprises a feed conductor 50 and a ground conductor 52 depicted in phantom in FIG. 1. In the illustrated embodiment, each of the feed and ground conductors 50 and 52 comprises an L-shaped structure having a first segment disposed in a plane parallel to the plane of the radiator 11 and a second segment conductively connected at a substantially right angle to an edge 60. In one embodiment, the distance between the plane of the first segment and the plane of the radiator is about two to three millimeters. Thus the height of the antenna 10 is about 2 to 3 mm. When the antenna 11 is installed in a communications device, such as a cellular telephone handset, the first segment of each of the feed and the ground conductors 50 and 52 is connected to a signal feed terminal and a ground plane, respectively, of the communications device. Generally, such an antenna is considered a low profile antenna.

According to the embodiment of FIG. 1, a shape of the high band region 12 comprises an inverted T, wherein one arm of the inverted T is longer than another. The arms, designated 12A and 12B in FIG. 1, further comprise tabs 12C and 12D extending from the arms 12A and 12B as illustrated. Generally, the high band region 12 comprises a planar conductive region disposed in an interior region of the radiator 11. The low band region 13 is generally disposed in a boundary region of the radiator 11.

Alternative shapes for the high and low band regions 12 and 13 are described below. It is known by those skilled in the art that other shapes can be used to provide the desired resonant condition, so long as the shape provides an appropriate current path length relative to the desired resonant frequency.

Figure 2:
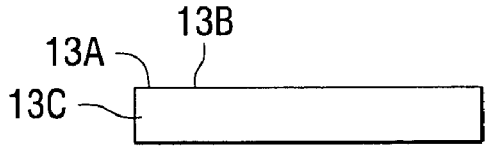
FIGS. 2 and 3 are views taken along different edges of the antenna of FIG. 1.

A region 13C is disposed on a side surface of the antenna 10 and conductively connected to the region 13B along the edge 13A, as illustrated in an end view of FIG. 2, which is taken along the plane 2—2 in FIG. 1. In one embodiment, the region 13C extends from the radiator plane for a distance of about 2 to 3 mm.

Figure 3:
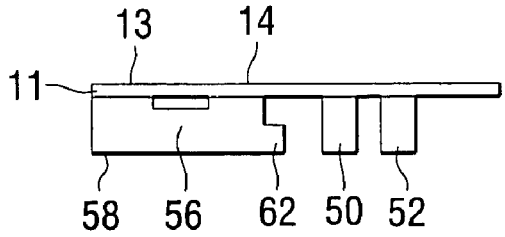

FIG. 3 illustrates an end view of the antenna 10 taken along the plane 3—3 of FIG. 1. FIG. 3 generally indicates the location of the segments 13 and 14, which are conductively connected by a conductive bridge 56. An edge 58 of the bridge 56 is spaced apart from the radiator plane by a distance of about 2 to 3 mm. In one embodiment, the bridge 56 comprises a tab region 62 extending from an edge thereof, although this may not be required In one embodiment, the radiator 11 is formed from a sheet of planar conductive material (copper, for example) from which material regions are removed to form the antenna elements as described and illustrated above. After formation of the elements in planar form, the conductive sheet is formed into the three-dimensional antenna structure by known bending processes. In another embodiment, the antenna 10 and its constituent elements are constructed using known patterning and subtractive etching processes on a conductive layer disposed on a dielectric substrate.

Figure 4:
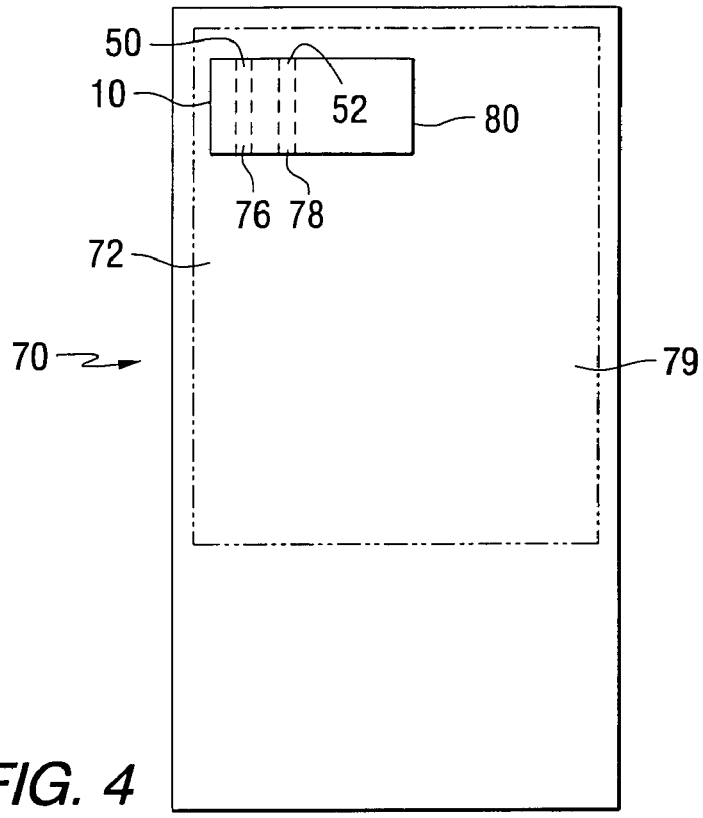
FIG. 4 illustrates an antenna constructed according to the teachings of the present invention mounted within a communications device.

FIG. 4 illustrates the antenna 10 installed in a communications device 70, such as a cellular telephone handset. A printed circuit board 72 comprises a dielectric substrate carrying electronic components associated with operation of the communications device 70, such as transmitting, receiving and signal processing components and conductive interconnect regions disposed thereon for connecting the electronic components.

The printed circuit board 72 further comprises a feed terminal 76 for connecting to the feed conductor 50 and a ground terminal 78 for connecting to the ground conductor 52. Typically, an upper layer (or in other embodiments, a lower layer or an intermediate layer) of the printed circuit board 72 comprises a ground plane indicated generally by a reference character 79. In one embodiment of the communications device 70, the ground plane 79 does not extend below the antenna 10. That is, the ground plane is absent from a region generally indicated by a reference character 80.

The feed and the ground conductors 50 and 52 display slow wave characteristics due to the effect of the dielectric constant of the printed circuit board underlying the antenna 10. According to another embodiment of the invention, the feed and the ground conductors 50 and 52 are physically lengthened (or shortened) or electrically lengthened (or shortened) by utilizing additional meanderline structures, to effect antenna performance, especially the frequencies at which resonant conditions are established.

It is generally known that an antenna disposed over a ground plane must be spaced from the ground plane by a minimum distance of about 5 mm for the antenna to achieve the desired performance bandwidth, particularly at low antenna resonant frequencies such as 869–894 MHz and 824–849 MHz, which are assigned frequencies for devices operating according to the CDMA (code division multiple access) protocol, and at 880 to 960 MHz for devices operating according to the GSM (global system for mobile communications) protocol. For improved performance, according to the prior art the antenna/ground plane separation distance is typically maintained at about 7 to 8 mm.

One application for the antenna 10 of the present invention comprises a handset communications device wherein the allowed maximum distance between the plane of the radiator 11 and a plane of the printed circuit board 72 is only about 3 mm. Therefore, according to the teachings of the present invention, to achieve the desired antenna bandwidth, the ground plane 79 of the printed circuit board 72 is absent in the region 80 proximate the radiator 11. See FIG. 4. With this configuration, a distance between a region of high surface currents on the antenna 10, i.e., where the feed and ground conductors 50 and 52 are connected to the radiator 11, and the ground plane 79 is greater than about 3 to 5 mm. Generally, this distance is sufficient to provide the desired bandwidth at the antenna resonant frequencies, notwithstanding that the antenna height above the printed circuit board 72 is only about 3 mm.

Additionally, since the antenna 10 is relatively thin, the antenna elements must by nature be short and certain resonant conditions may not be attainable according to the prior art. Use of slow wave structures for the feed and ground conductors 50 and 52 allows these structures to present an electrical length that is greater than the physical length, thereby compensating for the thin antenna structure.

Figure 5:
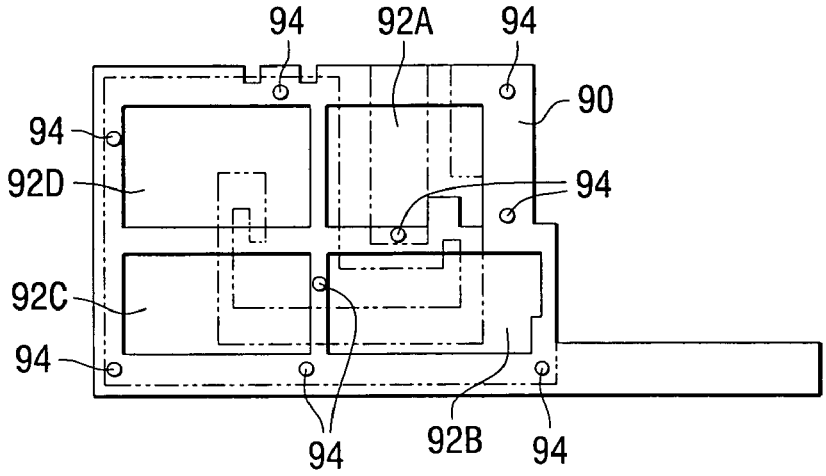
FIGS. 5 and 6 illustrate a carrier for use with an antenna of the present invention.

FIG. 5 illustrates a top view of an exemplary carrier 90 for mating with the antenna 10 to provide physical support to the antenna and its elements, ensuring that they remain in the correct relative physical relationships when installed in a communications device. So that the antenna elements can be related, at least generally, to the carrier features, certain antenna elements are illustrated in phantom in FIG. 5.

When mated with the carrier 90, the radiator 11 is disposed proximate an upper surface 90A of the carrier 90, and the feed and ground conductors 50 and 52 are disposed proximate a lower surface 90B. See FIG. 6. The bridge 56 (see FIG. 3) and the region 13C (see FIG. 2) are disposed on vertical side surfaces of the carrier 90. Thus, the antenna 10 essentially captures the carrier 90.

In one embodiment, the carrier 90 is formed from a plastic material (several suitable materials are known to those skilled in the art). The carrier defines a plurality of openings 92A, 92B, 92C and 92D that reduce the dielectric loading effect on the antenna 10. It is generally known that the preferable antenna dielectric material is air, as other materials that exhibit a higher dielectric constant than air tend to reduce the antenna bandwidth. Thus the openings 92A, 92B, 92C and 92D are sized to reduce the dielectric loading to the extent practicable, while providing adequate mechanical support to the antenna 10.

The antenna 10 mechanically captures the carrier 90 and is affixed to the carrier 90 at a plurality of attachment points 94, with a plurality of exemplary attachment points illustrated in FIG. 5. In one embodiment, each attachment point 94 comprises a tab extending from an upper surface of the carrier 90 through a mating hole in the antenna 10. An upper surface of each tab 94 protruding through the antenna mating hole is staked or expanded to slightly increase a tab diameter and thus affix the antenna 10 to the carrier 90. For example, a downward force applied to the upper tab surface expands an upper tab region to urge the antenna 10 into contact with the upper surface 90A of the carrier 90. It is desired to uniformly and securely attach the antenna 10 to the carrier 90, as variations in a distance between the carrier 90 and the antenna 10 can introduce antenna performance variations.

Figure 6:
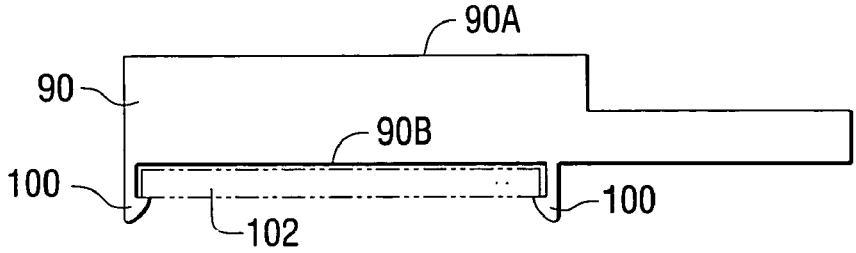

FIG. 6 is a front elevation view of the carrier 90. Tabs 100 extend from the bottom surface 90B of the carrier 90 for engaging an antenna support structure 102 (shown in phantom) within a communications device. Those skilled in the art recognize that there are several techniques for mounting the antenna 10 within a communications device, including the illustrated tab capture mechanism.

In another embodiment of an antenna of the present invention, the antenna is mechanically attached to the printed circuit board or other attachment structure without the use of a carrier. As is known to those skilled in the art, an antenna having only an air dielectric may exhibit different performance characteristics than an antenna operative with the carrier 90, although the carrier 90 is designed to maximize, to the extent practicable, the air dielectric volume.

Figure 7:
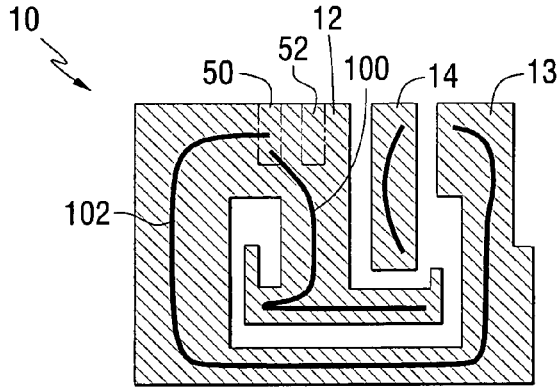
FIG. 7 illustrates current flow paths for the antenna of the present invention.

FIG. 7 illustrates antenna current paths 100 and 102 on the radiator 11. Current flow on the current path 100 produces a resonant condition at a first frequency (with an acceptable bandwidth above and below the first resonant frequency) wherein a length of the current path 100 is approximately equal to a quarter wavelength of the first frequency. In one embodiment, the first resonant frequency bandwidth is designated a high resonant frequency bandwidth (relative to the resonant condition of the second current path) and extends over a range between about 1800 MHz and 1900 MHz, which includes the DCS frequency band between 1710 and 1880 MHz and the PCS frequency band between 1850 and 1990 MHz.

Similarly, current flow on the current path 102 produces a resonant condition at a second or low resonant frequency (including a bandwidth above and below the low resonant frequency) wherein a length of the current path 102 is approximately equal to a quarter wavelength of the second frequency. Current flows from the low band region 13 to the segment 14 via the conductive bridge 56 (not visible in FIG. 7), such that the current path 102 includes the segment 14. In one embodiment, the low frequency resonant condition extends over a frequency band between about 880 and 960 MHz, which is the operational frequency band for the GSM service.

The current path 100 substantially comprises the high band region 12, but as is known to those skilled in the art, current flow is not necessarily confined to the high band region 12 during the high frequency resonant condition. Instead, current on the current path 100 dominates to produce the high frequency resonant condition for the antenna. Similarly, current flow on the current path 102 dominates to produce the low frequency resonant condition. Further, the illustrated current paths 100 and 102 are intended to generally depict regions of current flow during resonant conditions; those skilled in the art recognize that current flows throughout the high and low band regions 12 and 13 during their respective resonant conditions, and is not restricted to the illustrated current paths 100 and 102.

Figure 8:
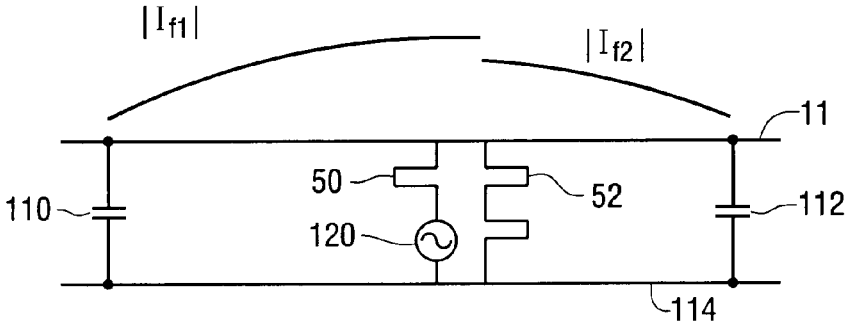
FIG. 8 is a schematic illustration of the antenna of the present invention showing a magnitude of the current within the antenna.
Figure 9:
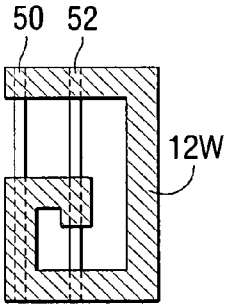
FIGS. 9–12 illustrate alternative inner segments for the antenna of the present invention.
Figure 10:
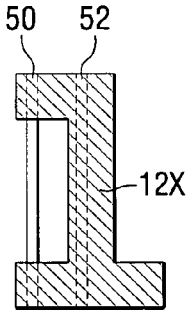
Figure 11:
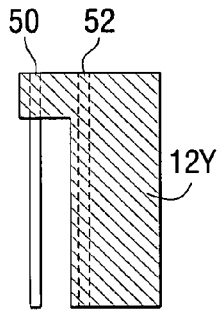
Figure 12:
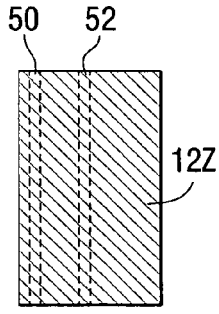
Figure 13:
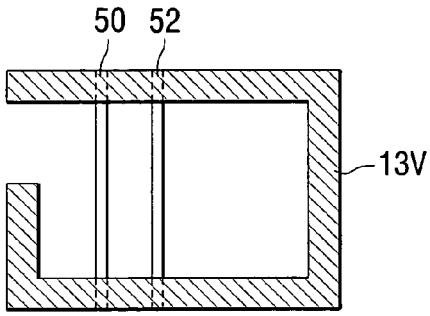
FIG. 13–17 illustrate alternative outer segments for the antenna of the present invention.
Figure 14:
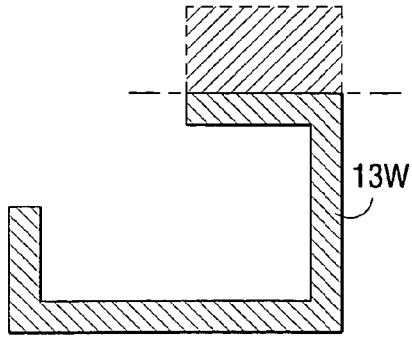

FIG. 8 is a schematic illustration of the antenna 10, indicating the current magnitude |I| for the current path 100 (high band resonance, |I f2|,) and the current path 102 (low band resonance, |I f1|). The current is maximum at the ground conductor 52, where the voltage is zero. Parasitic capacitors 110 and 112 between the radiator 11 and a ground plane 114 are illustrated schematically in FIG. 8.

As described above, in one embodiment the ground plane 114 is spaced laterally apart from the antenna 10 (see for example, FIG. 4) wherein the antenna 10 is installed in the communications device 70. In the illustration of FIG. 4, the ground plane 79 is absent from the region 80 immediately below the antenna 10. Since FIG. 8 is a schematic illustration, the ground plane is depicted as disposed below the radiator 11, but this is not intended to suggest that the ground plane is physically disposed below the antenna 10.

In FIG. 8, both the feed conductor 50 and the ground conductor 52 are illustrated by a symbol identifying these elements as having meanderline characteristics. A signal source 120 is connected between the ground plane 114 and the feed conductor 50.

FIGS. 9–12 illustrate alternative shapes 12W–12Z for the high band region 12 of the antenna 10. FIGS. 13–17 illustrate alternative shapes 13V–13Z for the low band region 13 (including the segment 14 electrically connected thereto via the conductive bridge 56). These alternative shapes for the high band region 12 and the low band region 13 are intended to create current path lengths (one each for the high band and the low band) that will cause the antenna to resonate at the desired frequencies with the desired bandwidth. Any one of the illustrated high band regions can be used with any one of the illustrated low band regions if an available space envelope can accommodate the physical combination of the selected regions. Those skilled in the art recognize that the region shapes illustrated are merely exemplary and other shapes can provide suitable antenna performance.

Figure 15:
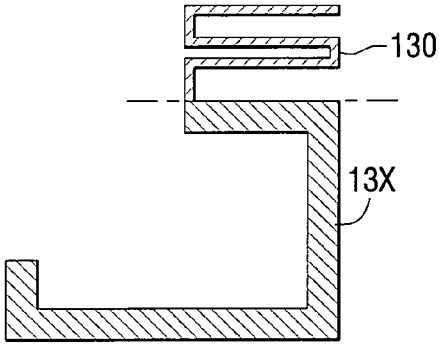
Figure 16:
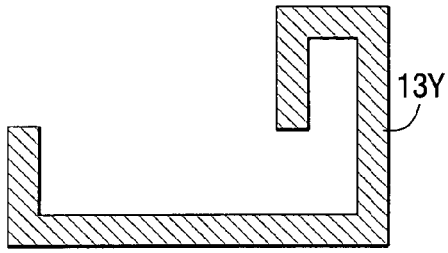
Figure 17:
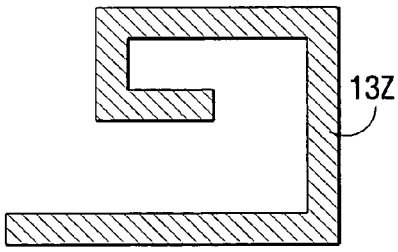

The embodiment of FIG. 15 further comprises a meanderline segment 130, for extending the electrical length of the outer segment 13X beyond its physical length. Such meanderline segments can be employed with any of the high band regions 12 and 12W–12Z and with any of the low band regions 13 and 13V–13Z.

Figure 18:
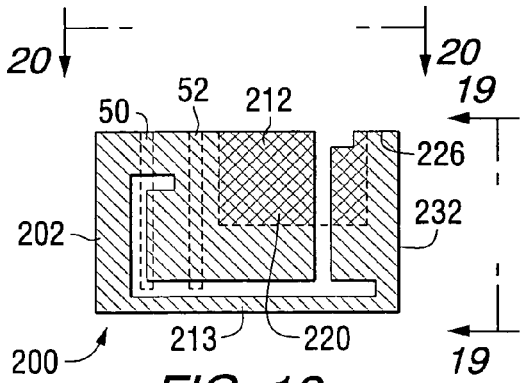
FIGS. 18–20 illustrate another embodiment according to the teachings of the present invention.
Figure 20:
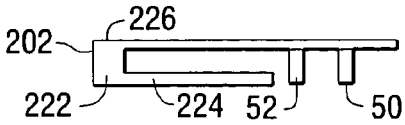
Figure 19:
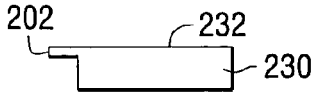

FIG. 18 illustrates an embodiment of an antenna 200 including a radiator 202 further comprising a high band region 212 (illustrated generally with perpendicular cross-hatches) and a low band region 213 (illustrated generally with single cross-hatches). As in the previous embodiments, the high band region 212 presents a shorter current path (and a higher resonant frequency) than the low band region 213. The low band region 213 further comprises a conductive region 220 disposed in a plane parallel to a plane of the radiator 202. As shown in FIG. 18 and the cross section of FIG. 20, a tab 222 extends from an edge 226 of the low band region 213, and a finger 224 further extends from the tab 222. The conductive region 220 extends from the finger 224. As illustrated in FIG. 18 and the cross section of FIG. 19, a conductive region 243 extends from an edge 232 of the low band region 213. Thus the region 220, the tab 222, the finger 224 and the region 243 are elements of the low band region 213 through which the low band resonant current flows.

In any of the presented embodiments the location of the ground conductor 52 can be modified to affect the antenna performance. That is, moving the ground conductor 52 in a direction toward the high band region 12 (or the high band region 212) shortens the current path 100 and lengthens the current path 102. As a result, the high resonant frequency, which is determined by the length of the current path 100, increases in frequency, and the low resonant frequency, which is determined by the length of the current path 102, decreases in frequency. An opposite shift in the frequency resonances can be accomplished by moving the ground conductor 52 in a direction toward the low band region 13, i.e., lengthening the current path 100 and shortening the current path 102.

Generally, according to the teachings of the present invention, the antenna embodiments presented herein can be tuned to operate in various frequency bands or at various resonant frequencies by adding meanderline elements, by adjusting the length of the meanderline elements and/or by lengthening and/or shortening resonant current path lengths within the antenna. In the latter case, the high band region 12 and the low band region 13 can be lengthened or shortened to change the resonant conditions. Also, relocating the ground conductor 52, as described above, changes a ratio between the high and low resonant frequencies. Lengthening the ground conductor 52 changes both the high and low resonant frequencies, but generally imparts a greater change to the high resonant frequency. The radiating energy transmitted by the antenna is linearly polarized.

Additional resonant frequency bands can be created by adding meanderline elements. By adjusting certain meanderline element lengths, resonances in one frequency band can be modified without affecting resonant conditions in other bands. Thus the antenna offers separately tunable resonant frequency bands. In prior art antennas it is known that changing one antenna physical characteristic or dimension typically affects all the resonant frequencies of the antenna. The antenna of the present invention is not so limited. Also, scaling the dimensions of the antenna of the present invention (e.g., length, width, height above the ground plane) generally affects all the resonant frequencies.

An antenna architecture has been described as useful for providing operation in one or more frequency bands. While specific applications and examples of the invention have been illustrated and discussed, the principals disclosed herein provide a basis for practicing the invention in a variety of ways and in a variety of antenna configurations. Numerous variations are possible within the scope of the invention. The invention is limited only by the claims that follow.

What is claimed is:

1. An antenna comprising:

a radiating conductive structure, further comprising:

a first current path for providing a resonant condition at a first resonant frequency;

a second current path for providing a resonant condition at a second resonant frequency, wherein the second current path comprises first and second segments in the plane of the radiating structure and a bridging segment electrically connecting the first and the second segments, the bridging segment extending out of the plane of the radiating structure along an edge of the second current path;

a common feed conductor for the first and the second current paths, wherein the feed conductor is connected to the radiating structure; and a common ground conductor for the first and the second current paths, wherein the ground conductor is connected to the radiating structure.

2. The antenna of claim 1 wherein at least one of the feed conductor and the ground conductor comprises a slow wave meanderline conductor.

3. The antenna of claim 1 wherein a segment of the feed conductor and a segment of the ground conductor are disposed in a plane parallel to a plane of the radiating structure.

4. The antenna of claim 1 wherein the first current path comprises a planar conductive region disposed in an interior region of the radiating structure.

5. The antenna of claim 1 wherein a first portion of the first current path is in a plane of the radiating structure and a second portion of the first current path is outside the plane of the radiating structure.

6. The antenna of claim 1 wherein the bridging segment is substantially perpendicular to the plane of the radiating structure.

7. The antenna of claim 1 wherein the first current path is shorter than the second current path and the first resonant frequency is higher than the second resonant frequency.

8. The antenna of claim 1 wherein the second current path further comprises a third conductive segment conductively connected to the second current path, the third conductive segment in a plane other than the plane of the radiating structure.

9. The antenna of claim 1 wherein the first current path extends from the feed conductor along a first path on the radiating structure, and wherein the second current path extends from the feed conductor along a second path on the feed conductor.

10. The antenna of claim 1 wherein the first current path is non-overlapping with the second current path.

11. The antenna of claim 1 installed in a communications device having a ground plane, wherein the ground plane is spaced apart from the antenna, wherein any line perpendicular to and passing through the radiating conductive structure does not pass through the ground plane.

12. The antenna of claim 11 wherein the ground plane is spaced apart from the antenna by a distance greater than or equal to about 5 mm.

13. The antenna of claim 11 wherein the ground plane is spaced apart from a location where the feed conductor is connected to the radiating structure by a distance greater than or equal to about 5 mm.

14. The antenna of claim 11 wherein the ground plane is spaced apart from a location where the ground conductor is connected to the radiating structure by a distance greater than or equal to about 5 mm.

15. The antenna of claim 1 installed in a communications device having a substrate for supporting the antenna and having a ground plane, wherein the radiating structure is spaced apart from the substrate by a first distance and spaced apart from the ground plane by a second distance greater than the first distance.

16. The antenna of claim 15 wherein the first distance is about 3 mm and the second distance is about 5 mm.

17. The antenna of claim 1 wherein a length of the first current path is substantially a quarter wavelength at the first resonant frequency and a length of the second current path is substantially a quarter wavelength at the second resonant frequency.

18. The antenna of claim 1 wherein the first resonant frequency is between about 1800 MHz and 1900 MHz and the second resonant frequency is between about 880 MHz and 960 MHz.

19. An antenna comprising:

a slow wave ground conductor;

a slow wave feed conductor;

a planar conductive radiator conductively connected to the ground conductor and the feed conductor, the radiator comprising:

a high band region providing a first current path having a length to create a resonant condition at a first frequency; and a low band region providing a second current path having a length to create a resonant condition at a second frequency, the second current path comprising first and second planar conductive segments and a bridging segment conductively connecting the first and the second segments, the bridging segment extending out of a plane of the first and the second conductive segments.

20. The antenna of claim 19 further comprising a ground plane spaced at least 5 mm from the radiator.

21. The antenna of claim 19 further comprising a carrier for supporting the antenna, wherein the antenna is affixed to the carrier.

22. The antenna of claim 21 wherein the carrier defines a plurality of openings therein.

* * * * *